United States Patent [19]

Tang

[11] Patent Number: 4,867,706

[45] Date of Patent: Sep. 19, 1989

[54] FILTERED ELECTRICAL CONNECTOR

[75] Inventor: Tian-Peng Tang, Woodland Hills, Calif.

[73] Assignee: G & H Technology, Inc., Santa Monica, Calif.

[21] Appl. No.: 37,505

[22] Filed: Apr. 13, 1987

[51] Int. Cl.[4] ..... H01R 13/66

[52] U.S. Cl. ..... 439/620; 333/185

[58] Field of Search ..... 333/181–185; 439/620, 608

[56] References Cited

U.S. PATENT DOCUMENTS

| | | | |
|---|---|---|---|
| 4,494,092 | 1/1985 | Griffin | 333/183 |
| 4,729,743 | 3/1988 | Karrar et al. | 439/620 |
| 4,741,710 | 5/1988 | Hogan et al. | 439/620 |
| 4,746,310 | 5/1988 | Morse et al. | 439/620 |

FOREIGN PATENT DOCUMENTS

| | | | |
|---|---|---|---|
| 870243 | 5/1971 | Canada | 333/182 |

*Primary Examiner*—Gary F. Paumen

*Attorney, Agent, or Firm*—George J. Netter

[57] ABSTRACT

A filter connector comprising a conductive housing containing a pin array traversing corresponding holes in a grommet, a dielectric body, a planar capacitor array, ferrite inductor beads mounted on at least some of the pins, a non-conductive body to insulate said beads from one another and from said capacitor, a non-conductive seal, a second capacitor array, a second grommet, a second interface seal; a grounding cylinder surrounding said capacitor arrays and said beads in an electrical contact with a ring of contact fingers mounted in the interior of said housing. Optionally, a conductive O-ring encircles said shell, to improve shielding.

4 Claims, 1 Drawing Sheet

FILTERED ELECTRICAL CONNECTOR

BACKGROUND OF THE INVENTION

1. Field of the Invention

This invention relates to a multi-pin electrical connector with built-in electromagnetic interference (EMI) filtering capability.

2. Description of the Prior Art

Filtering multi-pin electrical connectors to combat EMI problems, are known. It is usual to make these connectors with ceramic capacitors and inductors; the elements of which are brittle and so fragile that they do not provide desired reliability. Also, prior filter connectors are deficient in electrical continuity of the filter circuits and in provision of good attenuation. Arcing between inductors is also a problem in some of these.

OBJECTS AND SUMMARY OF THE INVENTION

It is an object of this invention to provide a multi-pin filter connector that possesses internal electrical integrity.

Another object is the provision of a connector that resists EMI coupling through connector part interfaces and accessory interfaces.

Yet another object is provision of such a connector that is ruggedly constructed.

Still another object is to eliminate arcing between inductors or inductors and capacitors in a filtering electrical connector.

The invention is directed to a multi-pin electrical connector providing EMI filtering for as many as desired of the electrical pins in said connector, which filtering connector comprises: a multiplicity of electrical pins; a first non-conductive grommet seal provided with openings for said pins, said grommet being positioned at the outer surface of a dielectric body having openings corresponding to said pins; a first planar ceramic capacitor array having openings corresponding to said pins; ferrite inductor beads mounted on and around each of said pins which are desired to be filtered; a non-conductive elastomer body provided with openings to accept each of the pins with inductor beads and the non-filter pins, and a non-conductive interface seal, provided with openings for receiving said pins, positioned against the outer face of said elastomer body; a second planar ceramic capacitor array having openings corresponding to said pins; a second nonconductive grommet seal, provided with openings for said pins, positioned at the outer face of said second capacitor; a second non-conductive interface seal, provided with openings for said pins, positioned at the outer face of said second grommet; a conductive grounding cylinder encircling said second capacitor array and also a portion of said dielectric body, and capable of being placed into electrical contact therewith; a conductive shell adapted for housing the pins, beads and capacitor arrays; and supported within said shell, a conductive ring element providing a multiplicity of resilient contact fingers for making electrical contact with said grounding cylinder and providing an electrical grounding path from said capacitor arrays to said shell. Desirably, each of the two capacitor arrays and each of said pins are soldered together. To further ensure shielding effectiveness at a connector mounting hole a conductive ring, such as an O-ring, is positioned on and around said shell.

DETAILED DESCRIPTION OF PREFERRED EMBODIMENTS

Figure 1:
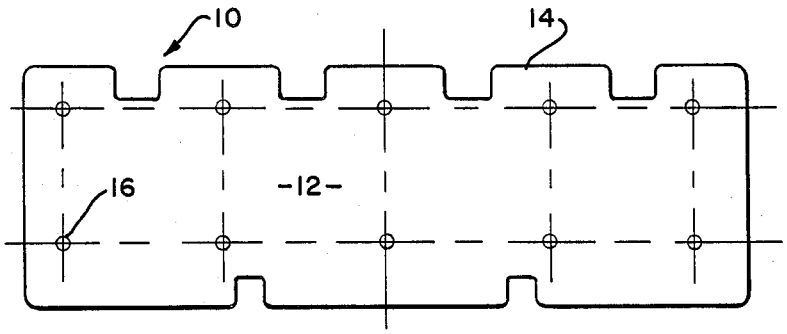
FIG. 1 is a plan view of the blank from which the electrical ground cylinder is formed for use in the filtering connector of the invention.
Figure 2:
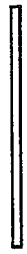
FIG. 2 is a side elevational view of the cylinder blank of FIG. 1.
Figure 3:
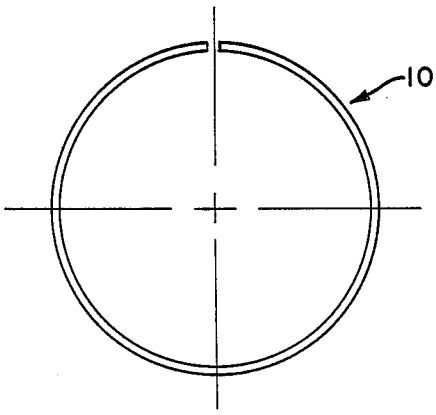
FIG. 3 is a top plan view of the formed cylinder.

FIGS. 1–3 show the details of the grounding cylinder 10 of the filter connector of the invention. Cylinder 10 is formed from a conductive strip 12 provided with a number of tabs 14 along top and bottom edges, and a number of fastener holes 16. The tabs 14 in this embodiment conform to the configuration of the outer surface of the electrical connector contact pins with filtering elements to be described which will be referred to on occasion herein as the "pin array".

FIG. 2 shows that cylinder 10 is formed from a blank consisting of a foil thickness, which thickness is only that necessary to provide support strength to connector contact pin array as will be described.

FIG. 3 shows the cylinder 10 in its formed configuration for encircling a hereinafter defined pin array not only to strengthen the pin array, but also to permit the conductive strip 12 being laced into electrical contact therewith. In this embodiment cylinder 10 is made from a beryllium copper alloy having a foil thickness such that the formed cylinder is strong enough to support the more fragile elements of the pin array, as well as pass to ground stray electrical currents induced into the shell of the connector.

Figure 4:
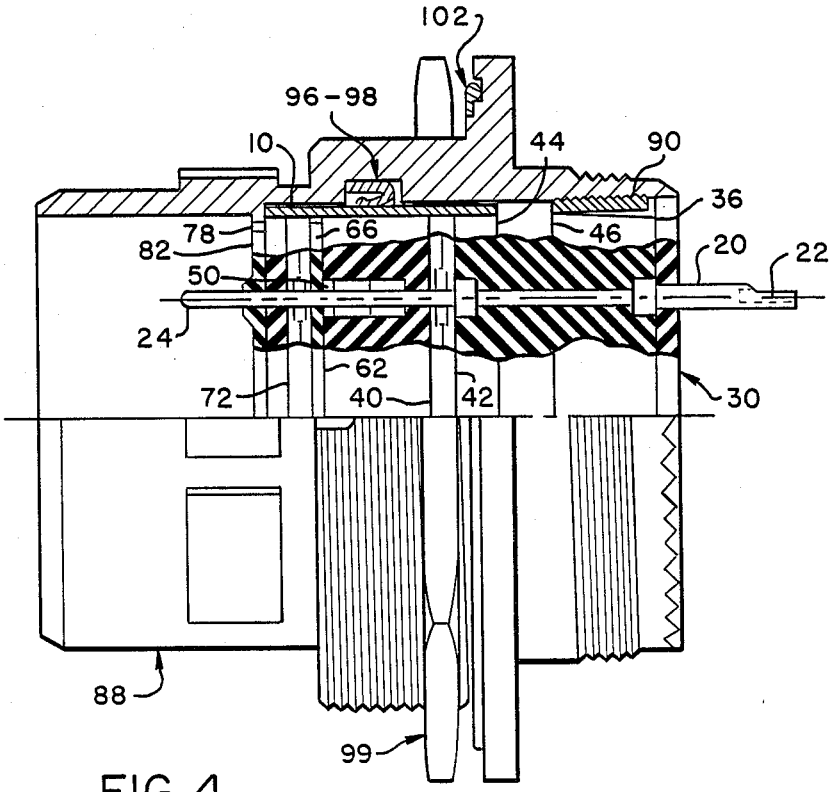
FIG. 4 is a side elevational, partially sectional view of the filtering connector of the invention.

FIG. 4 shows in partial section one embodiment of a multi-pin electrical filtering connector of the invention. This embodiment is a circular, jam nut style configuration although the invention is not limited to this configuration.

The filtering connector typically will include a multiplicity of electrical pins, although only one pin 20 is shown in FIG. 4, each having a pin contact end 22 and an opposite end 24. It is to be understood that it is not necessary that all of the pins 20 be filtered. A mix of filtered pins and non-filtered pins may fit predetermined certain needs, although on occasion all pins may be filtered.

Positioned near the contact end 22 of pin 20 is a first non-conductive grommet seal 30 provided with openings for pins 20 to pass through. The grommet 30 may be made from an electrically non-conductive elastomeric material, such as, fluorosilicone rubber, for example. As used herein, 'non-conductive' and 'dielectric' are synonyms.

A dielectric body 36 having openings corresponding to pins 20 is located after the grommet 30. The dielectric body 36, also referred to as a first insert, is preferably made from an epoxy molding compound, sold under the trade designations Epiall or Fiberite, to enclose a portion of said pins 20 and to cushion against physical shocks.

Positioned in contact with the interior face 42 of insert 36, is a first planar ceramic capacitor array 40 having openings corresponding to said pins 20. These monolithic ceramic planar capacitor arrays, either circular or rectangular, are available commercially, such as MIL-C-38999 Circular Planar Capacitor Array series of AVX.

Ferrite Inductor beads 50 are mounted on and around each of said pins 20 which are desired to be filtered. These ferrite beads are available commercially from several sources.

A non-conductive elastomer body or second insert 58 is provided with openings to accept each of said ferrite beads 50 mounted on a pin 20 and any non-filtered pins. The second insert 58 separates physically and insulates said ferrite beads 50 one from another and also from said first capacitor 40. This insulation eliminates electrical arcing between beads or beads/capacitor.

The elastomer body 58 has positioned against its outer face 62 a non-conductive interface seal 66 provided with openings for receiving said pins 20.

Positioned against the face of seal 66 is a second planar ceramic capacitor array 72 having openings corresponding to said pins 20.

After said second grommet 78 there is positioned a second non-conductive interface seal 82 having openings for receiving said pins 20.

A conductive grounding cylinder 10 encircles said elements depicted in FIG. 3 extending from second grommet 78 to said first capacitor array 40 and beyond to include a portion of said dielectric body 36. Grounding cylinder 10 unitarily supports the various elements, as well as providing an electrical path from said pin array to a shell to be described.

The filtering connector includes outer conductive shell 88 for housing the pin array. A retaining ring 90 inside shell 88 and interior of grommet 30 holds insert 36 within the shell.

There is supported within shell 88 a conductive ring element 96 providing a multiplicity of resilient contact fingers 98 for making electrical contact with said grounding cylinder 10 and also providing an electrical grounding path from said pin array to said shell 88. These rings with spring contact fingers are available commercially such as beryllium copper design Q, 97-252:255, of Instrument Specialties Co., Inc. Delaware Water Gap, Pa. 18327

Superior results are obtained when the pin array and the two capacitor arrays are further bound together. Preferably, each capacitor arrays the pins are soldered together. Desirably this is done using a Phase Four Model 1214 Vapor Phase Soldering System of Dynapert HTE-Emhart, Concord, Mass. 01742.

In jam nut 99 installations, apertures may permit entry of stray EMI at the mounting interface. To further ensure shielding effectiveness at the connector mounting opening, shell 88 has positioned on and around it a conductive ring 102. Typically, ring 102 is a conductive elastomer O-ring.

EXEMPLARY

Six specimens of the filter connector of the invention fabricated by vapor phase soldering were subjected to sinewave vibrations in accord with a standard military test. Visual inspection at the conclusion of each test revealed no damage to any specimen.

Specimes were tested and found to be acceptable for military usage of filter connectors of the invention, including vapor phase soldering, having receptacle shell sizes: 11, 13, 15, 17, 19, 21, 23 and 25; Mount Type: box mount, wall mount, jam nut; Pin size: 22D and 20; the Filter Circuit was low-pass Pi-section.

These specimens displayed:

| | |
|---|---|
| CAPACITANCE | 5000 pf to 15000 pf @ 1 KHz and +25 C. |
| WORKING VOLTAGE | 50 V, 100 V, 200 V |
| CURRENT RATING | 5 Amps., 7.5 Amps. |
| R.F. CURRENT CAPACITY | 3.0 Amps. |
| INSULATION RESISTANCE | 10,000 Megohms @ +25 C. |
| DIELECTRIC WITHSTANDING VOLTAGE | 300 VDC, 500 VDC @ +25 C. |
| OPERATING TEMPERATURE | −55 C. to +125 C. |
| ATTENUATION | 18 dB minimum at 10 MHz. 65 dB minimum at 100 MHz |

I claim:

1. A multi-pin filtered electrical connector providing EMI filtering, for as many as desired of pins in said connector, which filter connector comprises:

a multiplicity of electrical pins;

a first non-conductive grommet seal provided with openings for said pins, said first grommet being positioned at the outer face of a dielectric body;

said dielectric body having openings corresponding to said pins;

a first planar body having openings corresponding to said pins;

a first planar ceramic capacitor array having openings corresponding to said pins, positioned against said dielectric body;

ferrite inductor beads mounted on and around each of said pins which are desired to be filtered;

a non-conductive elastomer body provided with openings to accept each of said beads and each of the non-filtered pins, and to insulate said ferrite beads from each other and from said first capacitor array, said elastomer body being positioned against said first capacitor array;

a first non conductive interface seal, provided with openings for said pins, positioned against the outer face of said elastomer body;

a second planar ceramic capacitor array having openings corresponding to said pins, positioned against said first interface seal;

a second non-conductive grommet seal, provided with openings for said pins, positioned at the outer face of said second capacitor;

a second non-conductive interface seal, provided with openings for said pins, positioned at the outer face of said second grommet;

a conductive grounding cylinder encircling said second grommet seal and said first capacitor array and also a portion of said dielectric body, and capable of being placed into electrical contact with said grounding cylinder;

a conductive shell adapted for housing said pins, seals, dielectric body, elastomer body, capacitor arrays, and ground cylinder; and supported within said shell, a conductive ring element providing a multiplicity of resilient contact fingers for making electrical contact with said grounding cylinder and providing an electrical grounding path from said pin array to said shell.

2. The filter connector of claim 1 wherein each of said two capacitor arrays are soldered to each of said pins.

3. The filter connector of claim 1 wherein a conductive ring is positioned on and around said shell to further ensure EMI shielding effectiveness at a connector mounting hole.

4. The filter connector of claim 3 wherein said two planar capacitor arrays are soldered to each of said pins.

* * * * *